US006045084A

United States Patent [19]

Binner et al.

[11] Patent Number: 6,045,084

[45] Date of Patent: Apr. 4, 2000

[54] METHOD OF WINDING AN ADVANCING YARN TO FORM A YARN PACKAGE

[75] Inventors: Tobias Binner; Dieter Haak, both of Remscheid; Hermann Westrich, Wuppertal, all of Germany

[73] Assignee: Barmag AG, Remscheid, Germany

[21] Appl. No.: 09/122,957

[22] Filed: Jul. 27, 1998

[30] Foreign Application Priority Data

Jul. 26, 1997 [DE] Germany ..... 197 32 221

[51] Int. Cl.[7] ..... B65H 18/08

[52] U.S. Cl. ..... 242/486.7; 242/486.3

[58] Field of Search ..... 242/486.7, 486.3, 242/486, 486.1

[56] References Cited

U.S. PATENT DOCUMENTS

| | | | |
|---|---|---|---|
| 4,986,483 | 1/1991 | Ryu et al. | 242/486.7 X |
| 5,029,762 | 7/1991 | Behrens et al. . | |
| 5,100,072 | 3/1992 | Behrens et al. . | |
| 5,348,238 | 9/1994 | Yamauchi et al. | 242/486.3 X |
| 5,462,239 | 10/1995 | Klee et al. | 242/486 |
| 5,605,293 | 2/1997 | Imae et al. | 242/486.3 X |
| 5,605,294 | 2/1997 | Migaki et al. | 242/486 X |
| 5,816,513 | 10/1998 | Spahlinger | 242/486.7 X |

FOREIGN PATENT DOCUMENTS

| | | |
|---|---|---|
| 0 200 234 | 12/1986 | European Pat. Off. . |
| 0 391 101 | 10/1990 | European Pat. Off. . |
| 0 580 548 | 1/1994 | European Pat. Off. . |

*Primary Examiner*—Donald P. Walsh
*Assistant Examiner*—Minh-Chau Pham
*Attorney, Agent, or Firm*—Alston & Bird LLP

[57] ABSTRACT

A method of winding a continuously advancing yarn to form a package, and so as to define an initial winding time T and a normal winding time. During the normal winding time a contact roll is positioned to lie against the surface of the package being formed, and the winding spindle speed is controlled by the contact roll. During the initial winding time T, however, the rotational speed of the winding spindle is controlled by a speed change function, which associates in the course of the winding cycle a certain winding spindle speed to each package diameter, while maintaining a constant yarn speed during the winding.

11 Claims, 3 Drawing Sheets

METHOD OF WINDING AN ADVANCING YARN TO FORM A YARN PACKAGE

BACKGROUND OF THE INVENTION

The invention relates to a method of winding an advancing yarn to form a package, wherein a winding spindle is operated in a normal winding operation with a contact roll lying against the surface of the package being formed, and in an initial winding operation wherein the contact roll is spaced from the surface of the package being formed.

It is known to wind in takeup machines a yarn to a package by driving a winding spindle that receives the package. During a winding cycle, the drive of the winding spindle is controlled in such a manner that the yarn speed remains constant while winding the yarn. To control the rotational speed of the winding spindle, a contact roll lies against the surface of the package during the normal operation. The rotational speed of the contact roll is continuously measured and maintained constant by controlling the rotational speed of the package.

To enable a catching of the yarn on the tube receiving the package, and to prevent damage to the initially wound layers, it is common practice to bring the contact roll into contact with the package surface only after completion of an initial winding phase.

The control of the winding spindle speed is started only after contact is made between the contact roll and the package surface. The startup of this speed control may occur after a predetermined winding time, as disclosed in EP 0 391 101. In this instance, the winding time must be determined such as to ensure that the contact roll and package surface are in contact at that point of time.

EP 0 200 234 discloses a method, which employs for starting up the control a position change of the contact roll that is detected by a sensor. In this method, a position sensing element is used directly for starting up the control.

EP 0 580 548 discloses a method, which employs the change of an operating parameter as a signal for starting up the control. Operating parameters may include the use of the rotational speed of the winding spindle or contact roll, the contact pressure, or the torque of the drives.

In all these methods, the rotational speed of the winding spindle remains uncontrolled during the initial winding operation. As a result of this, a more or less distinctive, sudden change of the winding spindle speed will occur during the transition to the controlled state (normal operation). This change is dependent on the predetermined slope for the speed change of the winding spindle. However, since the circumferential speed of the package is dependent on the yarn deposit, i.e., the diameter increase, a linear change in the rotational speed of the winding spindle results in that the yarn speed cannot be maintained constant during the initial winding operation. This again results in a change of the yarn tension during winding.

It is therefore the object of the invention to provide a method of the initially described type for winding a continuously advancing yarn, wherein the transition from the initial winding operation to the normal winding operation occurs without a significant change in the rotational speed of the winding spindle or the contact roll. A further object of the invention is to provide a method, wherein a package is wound over longer time intervals without controlling the rotational speed of the winding spindle.

SUMMARY OF THE INVENTION

In accordance with the invention, the above and other objects and advantages are achieved by controlling the rotational speed of the winding spindle during the winding time in the initial winding operation by a rotational speed change function, which predetermines at any point of time or at any diameter of the package a certain winding spindle speed while maintaining a constant yarn speed. This allows to impart to the winding spindle from the beginning, and even beyond the moment of contact between the package and the contact roll, a speed which comes close to that of a controlled process. The special advantage of the invention lies in that it is not necessary to exactly determine the position or the point of time, at which the contact occurs between the contact roll and the package.

Thus, it becomes possible to start the control as occurs during normal operation over a predetermined time, without having to fear an impairment as a result of unadapted speeds. The speed change function indicates the progression of the diameter of the package over the time, while a package is being wound. From the winding parameters, such as traversing speed, traverse stroke, crossing angle, and diameter of the tube, as well as from the dependent size of the yarn denier, it is possible to exactly predetermine the increase in diameter. It is therefore possible to determine the speed change from the condition that the yarn speed and, thus, the circumferential speed of the package can be constant during the winding cycle. With that, it is possible to associate to any moment within the winding time a rotational speed of the winding spindle, which ensures a constant yarn speed. In the place of time, one may also determine the rotational speed of the winding spindle within the winding time by the package diameter. The predetermined speed change function is supplied to a control device for controlling the drive of the winding spindle. Thus, the drive operates the winding spindle approximately at a controlled speed.

A very advantageous variant of the method provides that the package diameter is continuously computed at the beginning of the winding cycle. Based on the previously computed package diameter and the condition that the circumferential speed be proportionate to the yarn speed, it is possible to compute the associated rotational speed of the winding spindle. This variant of the method is especially advantageous during the startup of a process.

In a specially advantageous further development of the invention, the speed change function is determined during an acquisition of actual values that occurs in the normal operation. This actual speed change function is taken as basis for controlling the rotational speed of the winding spindle during the next change procedure. With that, it is possible to obtain, even in the uncontrolled initial winding range, conditions as are prevalent in the controlled normal operation. Even when the package surface comes into contact with the contact roll, no speeds will result that vary significantly from the controlled state. This kind of control of the winding spindle speed may be realized in any phase of the winding cycle, while the contact roll is not in contact with the package surface. Thus, it is also possible to apply the winding spindle speed at the end of the winding cycle, after the contact roll has been raised from the package.

BRIEF DESCRIPTION OF THE DRAWINGS

The method of the present invention is described in more detail with reference to one preferred embodiment and to the attached drawings, in which.

DETAILED DESCRIPTION OF A PREFERRED EMBODIMENT

Figure 1:
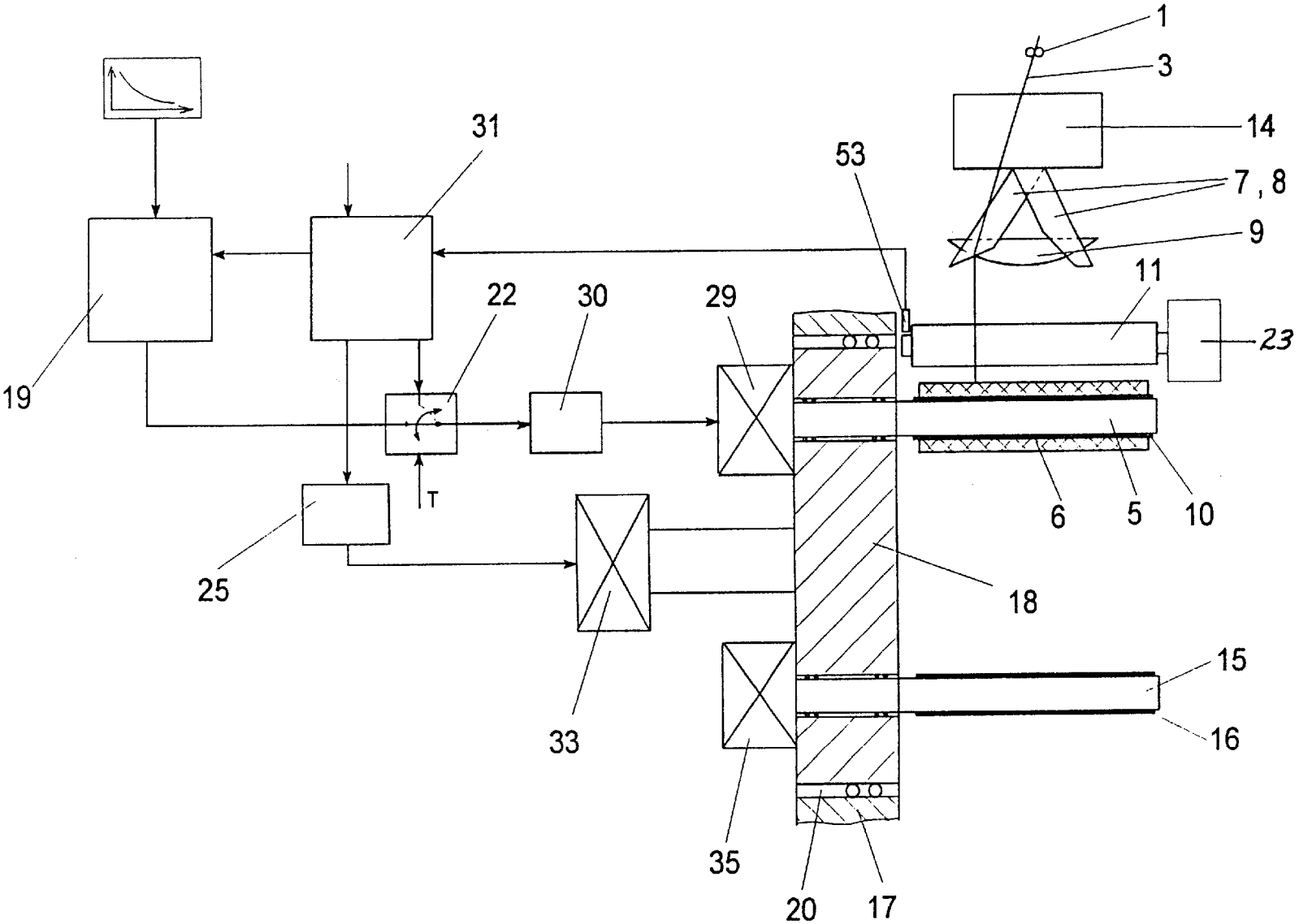
FIG. 1 is a schematic front view of an embodiment of a takeup machine during an initial winding operation.
Figure 2:
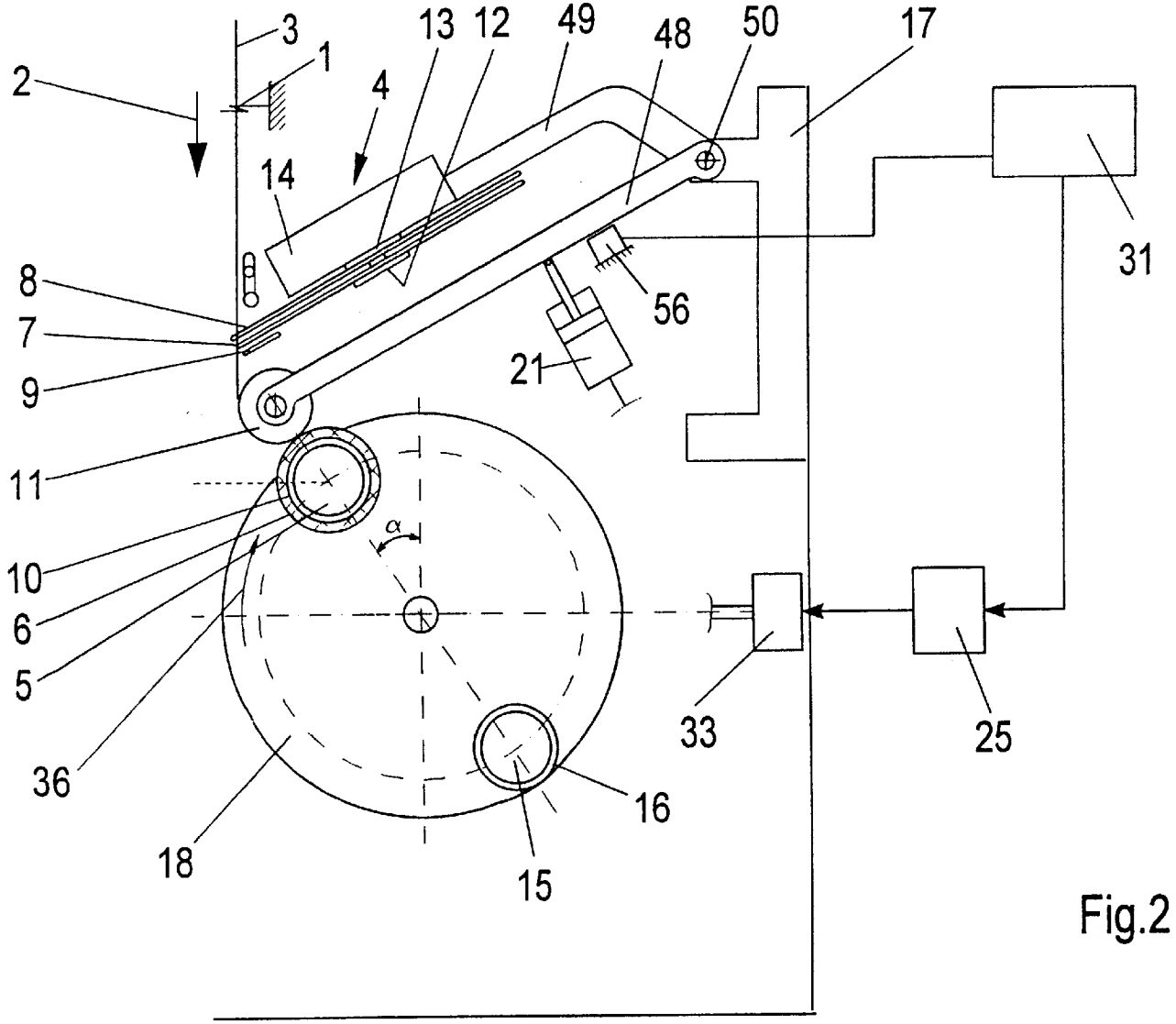
FIG. 2 is a schematic side view of the takeup machine of FIG. 1 during normal operation.

The following description applies to the embodiment shown in FIGS. 1 and 2.

A yarn 3 advances to a takeup machine at a constant speed. Initially, the yarn 3 travels through a yarn guide 1 which forms the apex of a traversing triangle. Thereafter, as it advances in direction 2, the yarn reaches a traversing mechanism 4, which is described further below.

Downstream of the traversing mechanism, the yarn is deflected on a contact roll 11 by more than 90° and subsequently wound on a package 6. The package 6 is formed on a winding tube 10. The winding tube 10 is mounted on a freely rotatable winding spindle 5. The winding spindle 5 mounting winding tube 10 and the package 6 being formed on the latter is in an initial winding operation in FIG. 1 and in a normal winding operation in FIG. 2.

The winding spindle 5 is mounted off center for rotation about a rotatable spindle turret 18, and it is driven by an electric motor 29. The electric motor 29 is mounted in alignment with spindle 5 on spindle turret 18, and it connects to an inverter 30.

During the initial winding operation, the inverter 30 is activated by a control device 19. The latter is connected, via a time switch 22, to the inverter 30. Likewise connected to the inverter via time switch 22, is a controller 31. The time switch 22 realizes a switchover from the initial winding operation to the normal winding operation. During the normal winding operation, the inverter is activated by controller 31, which receives signals from a rotational speed sensor 53. The rotational speed sensor 53 senses the rotational speed of the contact roll 11. The controller 31 activates the inverter 30 of winding spindle 5 in such a manner that during the normal operation the rotational speed of contact roll 11 and, thus, likewise the surface speed of package 6 maintain an actually predetermined value despite the increasing package diameter.

The spindle turret 18 mounts off center, about 180° out of phase from winding spindle 5, a second winding spindle 15 that is supported in cantilever fashion. The winding spindle 15 holds an empty tube 16, and it connects to a spindle motor 35 which is mounted on spindle turret 18.

The spindle turret 18 is mounted in a frame 17 of the takeup machine for rotation in a bearing 20, and it is rotated by a drive motor 33 in direction 36. The drive motor 33 is used to rotate the spindle turret 18 in a direction, so as to enlarge the center distance between the contact roll 11 and winding spindle 5 as the package diameter increases during the normal operation. The drive motor 33 is connected to an inverter 25. The inverter 25 is activated by controller 31. The controller 31 is connected to a position sensor 56 which determines the position of the contact roll 11 relative to the machine frame.

As shown in FIGS. 1 and 2, the contact roll 11 is mounted on a rocker arm 48, so that the contact roll 11 is able to perform a movement in radial direction relative to the package. The contact roll 11 is connected to a motor 23 which drives the contact roll during the initial winding phase at a constant circumferential speed corresponding to the yarn speed. The rocker arm 48 is mounted in the machine frame for pivotal movement about an axis 50.

A cylinder-piston unit 21 which is pneumatically biased and acts upon the rocker arm 48 from the bottom against the weight of the contact roll, permits adjustment of the contact force between the contact roll and the package. The cylinder-piston unit 21, however, is also used to raise the contact roll from the package.

In the embodiment of FIGS. 1 and 2, the yarn traversing mechanism is constructed as a so-called "rotary blade type traversing apparatus." It comprises two rotors 12 and 13, which are interconnected by a gearing (not shown) and driven by a motor 14. The rotors 12 and 13 mount rotary blades 8 and 7.

The rotors rotate in different directions of rotation. In do doing, they guide the yarn along a guide edge 9. One of the rotary blades guides the yarn in the one direction and moves below the guide edge, while the other rotary blade assumes guidance in the other direction and subsequently moves below the guide edge. The yarn traversing mechanism 4 is mounted for movement in the frame of the takeup machine. To this end, a rocker arm 49 is used. Same mounts on its one end the yarn traversing mechanism. On its other end, it is supported for pivotal movement in such a manner that the yarn traversing mechanism is able to perform a movement perpendicular to itself and relative to the contact roll, namely a parallel displacement.

The operation of the takeup machine is described in the following:

FIG. 1 shows the start of a winding cycle, i.e., the takeup machine is in its initial winding operation. Only few layers of yarn are wound on the empty tube 10. The contact roll 11 is in a predetermined position at a distance from the package 6.

The package 6 is driven, via winding spindle 5, by spindle motor 29. In this instance, the spindle motor 29 is controlled by inverter 30 which is connected, via time switch 22, to control device 19. Prestored in control device 19 is a speed change function, which is supplied as electric pulses to the inverter for a continuous variation of the frequency. As a result of varying the frequency in accordance with the speed change function, the spindle drive 29 operates at a constantly varying rotational speed. In this connection, a circumferential speed is adjusted on package 6, which is substantially the same as the yarn speed. This ensures that the yarn 3 is wound on the package 6 at a constant yarn tension and a constant yarn speed. In addition thereto, a relative speed is absent between the surface of package 6 as the two surfaces contact each other. The spindle drive 29 is a synchronous motor. With the use of an asynchronous motor the rotational speed of the winding spindle would be determined by means of a sensor and be supplied to the control device 19.

During the initial winding operation, the contact roll 11 is driven at a constant speed by motor 23. In this instance, the circumferential speed of the contact roll is the same as the yarn speed.

Thus, the contact between the contact roll and the package leads to no significant change in the winding parameters. After the contact is made between the contact roll 11 and the package 6, the time switch 22 will be activated after a winding time T has elapsed, so that the motor 29 is activated by controller 31. The takeup machine is now in its normal operation. During this operation, the control functions in such a manner that the rotational speed of contact roll 11 increases as the package diameter becomes larger. The rotational speed of contact roll 11 is sensed by rotational speed sensor 53 and supplied to controller 31. The measured rotational speed of the contact roll 11 is compared with a desired rotational speed of the contact roll. As a function of a differential signal, the controller 31 activates inverter 30 for purposes of adjusting the winding spindle drive 29 in such a manner that the contact roll which is driven by the package surface during normal operation, reaches its desired rotational speed.

Besides adjusting the winding spindle speed, the controller continuously computes during normal operation the package diameter from the rotational speed of the contact roll, the diameter of the contact roll, and the rotational speed of the winding spindle. The continuously determined package diameter and the rotational speed of the contact roll are supplied to the control device 19. A microprocessor within control device 19 determines the speed change function from the actual values of the spindle diameter and the rotational speed of the contact roll. The determined actual speed change function is taken as basis for controlling the winding spindle speed during a subsequent change procedure. This procedure repeats itself after each winding cycle, thereby ensuring an automatic adaptation to variable process parameters. The controlled rotational speed during the initial winding operation corresponds almost to the speed characteristic of the package surface of a controlled process.

As shown in FIG. 2, the controller 31 adjusts not only the winding spindle speed during normal operation, but also controls a position change of the winding spindle 5 by rotating spindle turret 18. To this end, the position of rocker arm 48 is sensed, which mounts the contact roll 11 on its free end. Upon a deviation from a desired position, the inverter 25 will receive a signal, which activates the drive motor 33, so that the spindle turret 18 is rotated in clockwise direction. Once the contact roll 11 reaches its desired position, the spindle turret 18 will be stopped.

However, the position sensor 56 could also be arranged in the region of the spindle turret 18, so as to detect, for example, the angular position of the spindle turret. Since it is possible to associate to each package diameter a certain position of the spindle turret, it is possible to control the rotation of spindle turret 18 by the controller. In this instance, the controller receives a sequence of the desired positions as a function of the diameter. Based on the actual detection by the position sensor 56 and the continuously computed package diameter, the controller is able to generate a corresponding control signal for controlling the spindle turret 18.

For purposes of enabling with the takeup machine of FIG. 1 an initial winding of the package at the beginning of the process, the control device 19 receives a speed change function by which the winding spindle drive 29 is controlled. Such a speed change function defines the correlation between the winding spindle speed and the package diameter during the winding cycle on the condition that the yarn speed remain constant during the winding cycle.

Figure 3:
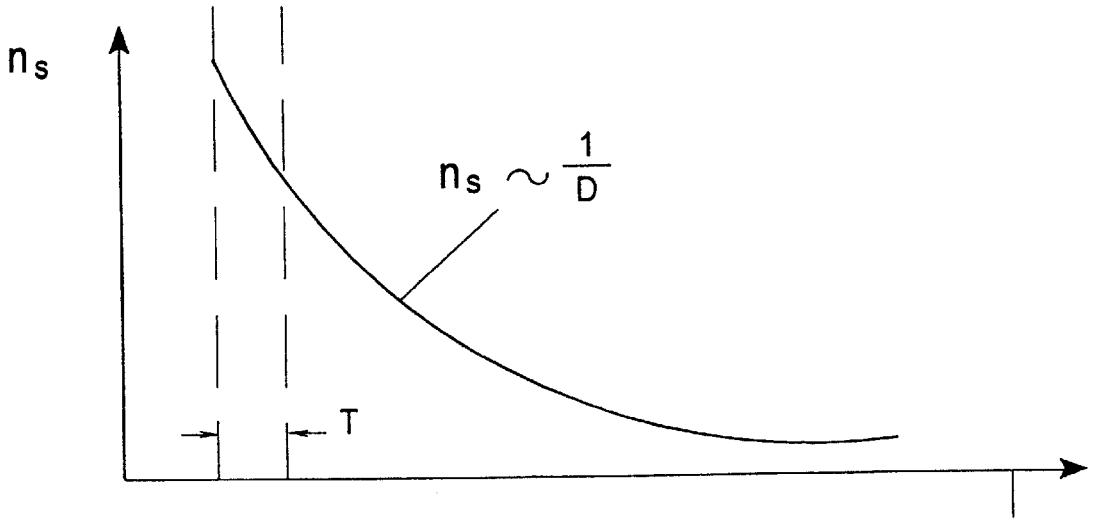
FIG. 3 is a diagram showing the curve of the rotational speed of the winding spindle as a function of the package diameter.

FIG. 3 shows a typical curve of a speed change function. The shape of the curve is approximate by the relation $n_s \sim 1/D$, i.e., the rotational speed of the winding spindle decreases approximately hyperbolically during the winding cycle. This means that the speed change, which is defined by the slope of the curve, shows a changed value at any time of a winding cycle. In the diagram of FIG. 3, the initial winding range, during which the winding spindle speed is controlled, is indicated by the winding time T. Thus, with an exact input or after an actual value acquisition of the speed change function, there will be no deviation between the controlled rotational speed and the adjusted rotational speed of the winding spindle during the transition from the initial winding operation to the normal winding operation. Since during the initial winding operation the contact roll 11 is driven at a constant speed, which realizes on the contact roll a surface speed corresponding to the yarn speed, a contact between the contact roll and the package will result in no change of the rotational speed.

Therefore, the method of the present invention is suitable for any phase of the winding cycle, during which there is no contact between the contact roll and the package and, thus, no possibility of adjusting the winding spindle speed. This allows to control in accordance with the speed change function, the rotational speed and the winding spindle with the full packages, for example, after the end of the winding cycle when the contact roll is raised from the package. Thus, the yarn will be wound at a constant speed until it is transferred to an empty tube.

We claim:

1. A method of winding a continuously advancing yarn to form a yarn package, comprising the steps of;

winding the advancing yarn onto a tube which is coaxially mounted on a driven winding spindle and so as to define an initial winding time T and a normal winding time, wherein during the normal winding time a contact roll is positioned to lie against the surface of the package being formed and the rotational speed of the winding spindle is controlled by the rotational speed of the contact roll so as to maintain a substantially constant yarn speed, and wherein during the initial winding time T the contact roll is spaced from the surface of the package being formed and the rotational speed of the contact roll is maintained substantially constant and the rotational speed of the winding spindle is controlled by a predetermined speed change function which determines the rotational speed change from the condition that the circumferential speed of the package is constant during the winding so as to maintain the substantially constant yarn speed.

2. The method as defined in claim 1 wherein the speed change function is calculated from the winding parameters for the initial winding time T and the calculated function is stored in a memory.

3. The method as defined in claim 2 wherein the speed change function is calculated for each point of time within the initial winding time T or for any package diameter.

4. The method as defined in claim 1 wherein the speed change function is calculated from an actual value acquisition taken during the normal winding time of a preceding one of a sequence of winding cycles.

5. The method as defined in claim 4 wherein the actual value acquisition is taken during the normal winding time of each of a sequence of winding cycles and for use during the next subsequent initial winding time T.

6. The method as defined in claim 1 wherein the initial winding time T is variable.

7. The method as defined in claim 1 wherein during the initial winding time T the constant rotational speed of the contact roll is such that the surface speed of the contact roll approximately equals the yarn advance speed.

8. The method as defined in claim 1 wherein the initial winding time T is divided into several time intervals, and wherein the speed change function is calculated for each time interval.

9. The method as defined in claim 1 wherein during the initial winding time T the speed change function associates a certain winding spindle speed to the increasing package diameter so as to maintain the substantially constant yarn speed.

10. The method as defined in claim 1 wherein the predetermined speed change function results in a non-linear rotational speed change of the winding spindle.

11. The method as defined in claim 10 wherein during the initial winding time T the constant rotational speed of the contact roll is such that the surface speed of the contact roll approximately equals the yarn advance speed.

* * * * *